US005283150A

United States Patent [19]

Tyagi et al.

[11] Patent Number: 5,283,150

[45] Date of Patent: Feb. 1, 1994

[54] ELECTROSTATOGRAPHIC TONER AND METHOD FOR THE PREPARATION THEREOF

[75] Inventors: Dinesh Tyagi, Fairport; Donna A. DiPrima, Rochester, both of N.Y.

[73] Assignee: Eastman Kodak Company, Rochester, N.Y.

[21] Appl. No.: 890,057

[22] Filed: May 28, 1992

[51] Int. Cl.[5] ..... G03G 9/08

[52] U.S. Cl. ..... 430/137; 430/110

[58] Field of Search ..... 430/137, 105, 107, 110

[56] References Cited

U.S. PATENT DOCUMENTS 4,789,617 12/1988 Arahara et al. ..... 430/137
4,833,060 5/1989 Nair et al. ..... 430/137
4,835,084 5/1989 Nair et al. ..... 430/137
4,965,131 10/1990 Nair et al. ..... 430/137
5,139,914 8/1992 Tomiyama et al. ..... 430/106.6
5,154,998 10/1992 Aoki et al. ..... 430/106.6

*Primary Examiner*—John Goodrow
*Attorney, Agent, or Firm*—Willard G. Montgomery

[57] ABSTRACT

A method is described for the preparation of electrostatographic toner particles which involves the surface treatment of pigments using a low melting point highly reactive wax. The method involves preparing a melt dispersion comprising a pigment, a polymeric binder and a low melting point wax at elevated temperatures, the wax melting and coating the surface of the pigment. The melt dispersion is then used as a component of the organic phase in a limited coalescence process.

18 Claims, No Drawings

ELECTROSTATOGRAPHIC TONER AND METHOD FOR THE PREPARATION THEREOF

FIELD OF THE INVENTION

This invention relates to polymeric powders suitable for use as electrostatographic toner and to a method for the preparation thereof, and more particularly, to a method for the preparation of toner particles including a surface active pigment coated with a hydrophobic wax.

BACKGROUND OF THE INVENTION

Heretofore, it has been common to prepare particulate electrostatic toner polymer particles by a process commonly referred to as "limited coalescence." In this process, polymer particles having a narrow size distribution are obtained by forming a solution of a polymer in a solvent that is immiscible with water, dispersing the polymer/solvent solution in an aqueous medium containing a solid colloidal stabilizer, and removing the solvent. The resultant particles are then isolated, washed and dried.

In the practice of this technique, toner or carrier particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by the agitation employed.

Limited coalescence techniques of this type have been described in numerous patents pertaining to the preparation of electrostatic toner particles because such techniques typically result in the formation of toner particles having a substantially uniform size and uniform size distribution. Representative limited coalescence processes employed in toner preparation are described in U.S. Pat. Nos. 4,833,060 and 4,965,131.

In the conventional limited coalescence techniques described heretofore, the judicious selection of toner additives such as charge control agents and pigments permits control of the surface roughness of toner particles by taking advantage of the aqueous organic interphase present. However, if any toner additive employed for this purpose is highly surface active or hydrophilic in nature, it tends to be present at the surface of the toner particles. Unfortunately, this leads to numerous potential problems such as lower charge/mass, rougher particles, poor thermal transfer, poor electrostatic transfer, reduced pigment coverage, interference with the limited coalescence process, sensitivity to the environment, and the like.

Accordingly, workers in the art have recognized that toner additives must either be avoided or kept way from the particle surfaces. One method for obviating this limitation is to select an additive which is neither surface active or hydrophilic in nature. However, it is often not feasible to find an alternative additive evidencing the properties sought. Thus, it then becomes necessary to modify the surface of the additive.

Efforts to achieve this end have focused upon the use of suitable dispersion aids as, for example, polymers with acid or other polar functionality as described in copending application Ser. No. 501,819 filed by M. Nair, Z. Pierce and D. Tyagi. These polymeric stabilizers are used to treat carbon pigment in order to prevent the hydrophilic carbon from migrating to the surface. Toners prepared in this manner evidence enhanced electrostatic transfer, reduced electrical conductivity, and low D-min or fog.

A similar treatment employed in conjunction with toners of smaller particle size has frequently been found unsuccessful due to an increase in solution viscosity of the organic phase at the concentration of dispersant and pigment level employed. Limited coalescence toners prepared with an organic phase of this type tend to yield particles of broad size distribution and tend to interfere with the limited coalescence process. Furthermore, use of this technique requires the presence of reactive sites on the additive surface of the toner particles to which a dispersant may associate.

SUMMARY OF THE INVENTION

In accordance with the present invention, the prior art limitations are effectively obviated by a novel process in which a highly surface active hydrophilic pigment is coated with a hydrophobic wax which is insoluble in the solvents commonly used in toner preparation. The wax coating prevents the pigment from migrating to the surface of the toner and improves the regularity of the surface thereof. This results in a narrow distribution of charge from particle to particle which permits image transfer without the occurrence of fog in the background. Furthermore, by preventing the pigment from migrating to the surface, the probability of carrier surface contamination from the toner particles is reduced. The described invention also results in the formation of a wax coating on the pigment which assures that the pigment will be spaced inwardly from the surface of the toner particles while providing the requisite color and avoiding charge disturbance by either wax or pigment. By employing the surface modified active agents described above and defined hereafter, the surface activity of the particles is reduced so that the particulate material produced evidences charging characteristics that render the particles suitable for use as electrostatographic toner particles.

Viewed from one aspect, the present invention is directed to a method for the preparation of electrostatographic toner. The method comprises the steps of forming a melt dispersion at elevated temperatures by mixing a pigment, a low melting point wax and a first polymer material; mixing the melt dispersion with a second polymer material, if required and as dictated by the concentration of the dispersion, a solvent and a charge control agent to form an organic phase; dispersing the organic phase in an aqueous phase comprising a buffer and a particulate stabilizer and homogenizing the mixture; and evaporating the solvent and washing and drying the resultant product.

Viewed from another aspect, the present invention is directed to a process for preparing electrostatographic toner by dispersing an organic phase in an aqueous phase to yield a layer of particulate suspension stabilizer on the surface of a polymer. The improvement in the process comprises forming a melt dispersion comprising a pigment, a first polymer material and a low melting point wax and mixing the melt dispersion with a second polymer material, as required, a solvent and a charge control agent to form the organic phase.

These and other features and advantages of the present invention will be better understood taken in conjunction with the following detailed description and claims.

DETAILED DESCRIPTION OF THE INVENTION

In accordance with the present invention, a pigment dispersion is first prepared by melt compounding techniques wherein a first polymer (binder), a pigment and a low melting point wax evidencing a low degree of crystallinity and a molecular weight of 20,000 or less are admixed, typically with a two roll mill hot roller. In this process, the pigment is broken into small pieces which mix with the polymer. The wax, which melts under the process conditions, coats the outer surface of the pigment particles due to the presence of polar groupings in the wax or its lower surface energy which causes it to attach to the pigment surface. It has been found advantageous in the practice of the invention to employ up to 50%, by weight, pigment, a maximum of 25%, by weight, reactive wax, remainder polymeric binder.

Following such preparation, the pigment dispersion is mixed with a solvent and optionally a second polymer, and optionally a charge control agent to form an organic phase in which the pigment concentration may range from about 0 to 40%, by weight. The charge control agent is employed in an amount ranging from 0 to 10 parts per hundred, based on the total weight of solids present with a preferred range from 0.2–3.0 parts per hundred. The solvent is employed in an amount ranging from about 250 to 900% based upon the total weight of the final product (total weight of solids present) and the second polymer is present in an amount ranging from 0 to 95% based upon the total weight of the final product. This mixture is permitted to stir overnight and then dispersed in an aqueous phase comprising a particulate stabilizer and optionally a promoter.

Any suitable solvent that will dissolve the polymer and which is also immiscible with water may be used in the practice of the present invention such as for example, chloromethane, dichloromethane, ethyl acetate, vinyl chloride, MEK, trichloromethane, carbon tetrachloride, ethylene chloride, trichloroethane, toluene, xylene, cyclohexanone, 2-nitropropane and the like. Particularly useful solvents in the practice of this invention are dichloromethane and ethyl acetate for the reason that they are both good solvents for many polymers while at the same time they are immiscible with water and can be readily removed by evaporation.

The particulate stabilizer selected for use herein may be selected from among highly cross-linked polymeric latex materials of the type described in U.S. Pat. No. 4,965,131 which issued on Oct. 23, 1990 to M. Nair et al. or $SiO_2$. The stabilizers typically have colloidal dimensions. The size and concentration of these particles controls and predetermines the size of the final toner particle. In other words, the smaller the size and/or the higher the concentration of such particles, the smaller the size of the final toner particles. The particulate stabilizer is generally used in an amount ranging from about 1 to 15 parts, by weight, of the final product.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. It will be appreciated by those skilled in the art that the promoter is required only when silica is employed as the stabilizing agent. When latex is employed for this purpose the hydrophobic/hydrophilic characteristics are provided by the choice of co-monomers used. Typical of such promoters are sulfonated polystyrenes, alginates, carboxy methyl cellulose, tetramethyl ammonium hydroxide or chloride, diethylaminoethylmethacrylate, water soluble complex resinous amine condensation products such as the water soluble condensation products of diethanol amine and adipic acid, water soluble condensation products of ethylene oxide, urea and formaldehyde and polyethyleneimine. Also effective for this purpose are gelatin, glue, casein, albumin, gluten and the like or nonionic materials such as methoxycellulose may be used. The promoter is generally used in an amount from about 0.2 to about 0.6 parts per 100 parts of aqueous solution.

Various additives generally present in electrostatographic toner may be added to the polymer prior to dissolution in the solvent or in the dissolution step itself, such as charge control agents. Suitable charge control agents are disclosed for example in U.S. Pat. Nos. 3,893,935; 4,079,014; 4,323,634 and British Pat. Nos. 1,501,085 and 1,420,839. Charge control agents are generally employed in small quantities such as from about 0 to about 10 parts per hundred based upon the weight of the final product (total solids present) and preferably from about 0.2 to about 3.0 parts per hundred based on the weight of the toner.

The resultant mixture is then subjected to mixing and homogenization. In this process the particulate stabilizer forms an interface between the organic globules in the organic phase and the aqueous phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume, may range from 1.5:1 to approximately 9:1. This indicates that the organic phase is typically present in an amount from about 10% to 40% of the total homogenized volume.

Following the homogenization treatment, the solvent present is evaporated and the resultant product washed and dried.

As indicated above, the invention is applicable to the preparation of polymeric toner particles from any type of polymer that is capable of being dissolved in a solvent that is immiscible with water and includes compositions such as, for example, olefin homopolymers and coploymers, such as polyethylene, polypropylene, polyisobutylene and polyisopentylene; polyfluoroolefins, such as polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methyl acrylate copolymers, ethylene-ethyl acrylate copolymers, ethylene-ethyl methacrylate copolymers, polystyrene and copolymers of styrene thereof with unsaturated monomers, cellulose derivatives, polyesters, polyvinyl resins and ethylene-allyl alcohol copolymers and the like. The first and second polymers described herein may be the same or different and may include any of the foregoing materials.

Pigments suitable for use in the practice of the invention should be capable of being dispersed in the solvent, be insoluble the aqueous phase and yield strong, permanent color. Typical of such pigments are the organic pigments such as phthalocyanines, lithols, and the like and inorganic pigment such as $TiO_2$, carbon black and the like. Typical of phthalocyanine pigments are copper phthalocyanine, mono-chlor copper phthalocyanine, hexadecachlor copper phthalocyanine, anthraquinone vat pigments such as vat yellow 6GL CI 1127, Quinone Yellow 18-1, Indanthrone CI 1106, pyranthrone CI 1096, brominated pyranthones such as dibromopyranthrone, vat brilliant orange RK, Anthramide Brown CI 1151, dibenzanthrone green CI 1101, flavanthrone yellow CI 1118, and metalized pigments such as azo yellow (green gold) and permanent red. The carbon black may be of any of the known types such as channel black or furnace black.

The waxes chosen for use in the practice of the present invention are insoluble in the solvents employed and may be selected from among any of the high molecular weight waxes evidencing a molecular weight of 20,000 or less and having a melting temperature within the range of 55°-120° C. These waxes are commonly available from commercial sources.

Waxes found to be particularly useful for this purpose include UNILINS (manufactured by Petrolite Co.), CERAMERS (manufactured by Petrolite Co.) and EPOLINE (manufactured by Eastman Kodak Co.). The waxes chosen for use herein should be less surface active than the pigment, and thus will be hydrophobic relative to the hydrophilic surface of the surface active pigment.

The invention will be more fully understood by reference to the following exemplary embodiments:

EXAMPLE 1

A melt dispersion was prepared by mixing on a two-roll mill at 130° C. 25 grams of a copolymer of vinyl toluene and ethyl hexyl acrylate ( PLIOTONE 4003 manufactured by Goodyear), 50 grams of quinacridone magenta (HOSTAPERM PINK EO2) pigment and 25 grams of a highly reactive high molecular weight wax having a melting temperature of 83° C. (UNILIN 700). 40 grams of the melt dispersion were then added to 60 grams of a butyl acrylate-styrene coplymer (PICCOTONER 1221), 400 grams of ethyl acetate and 1.0 gram of tetra decyl pyridinium tetraphenyl borate or any quaternary ammonium based charge agent while stirring overnight. Then, the mixture was mixed with an aqueous phase comprising 1500 grams of a buffer having a pH of 10 and 100 grams of latex particles (3% solids in water) and subjected to shear using a Polytron sold by Brinkman followed by a Microfluidizer. Upon exiting, the solvent was removed from the particles so formed by stirring overnight at room temperature in an open container. The particles formed were found to have a particle size ranging from 2 to 5 microns in nature. These particles were then washed with water and dried. The particles evidenced a size distribution ranging from 2 to 3 micrometers and are useful as electrostatographic toner. A direct comparison of the toner prepared in the foregoing manner was made by evaluating a quinacridone magenta pigment prepared by the limited coalescence technique of the prior art. Due to the extreme surface activity of this pigment, all limited coalescence toners prepared with it evidence surface irregularities as indicated by scanning electron micrographs. Similar toners with hydrophobic pigment yield highly spherical toner particles. However, according to the invention, the application of a coating of wax to the surface of the hydrophobic pigment yields limited coalescence particles of significantly greater regularity. Furthermore, it has been found that the charge/mass of such toners is higher and does not drop as is typically observed when the pigment is present at the surface. And lastly, the thermal transfer properties of such toners were enhanced by the presence of the wax coating since the pigment was not present at the surface. Additionally, the melt viscosity of the toner was reduced. The foregoing results were replicated by the use of a phthalocyanine pigment.

EXAMPLE 2

The procedure of example 1 was repeated with the exception that the UNILIN 700 was replaced by UNILIN 450, UNILIN 550 (manufactured by Petrolite Co.), EPOLENE E43 and EPOLENE E12 (manufactured by Eastman Kodak Co.) The resultant product prepared with these highly reactive waxes evidenced properties comparable to those obtained with the UNILIN 700 of Example 1.

EXAMPLE 3

The procedure of Example 1 was repeated with the exception that the melt dispersion was comprised of 50 grams of NOVAPERM YELLOW (manufactured by Hoechst Celanese Co.), 37.5 grams of a copolymer of vinyl toluene and ethyl hexyl acrylate manufactured by Goodyear (PLIOTONE 4003 ) and 12.5 grams of UNILIN 700 and the toner composition was comprised of 80 grams of a butyl acetate-styrene copolymer (PICCOTONER 1221) and 20 grams of melt dispersion. The resultant product prepared in this manner evidenced properties comparable to those obtained in Example 1.

While the invention has been described in detail with reference to certain preferred embodiments, it will be understood that variations may be made by those skilled in the art without departing from the spirit and scope of the invention. Thus, for example, different polymer compositions and pigments may be utilized throughout the examples for those employed.

What is claimed is:

1. A method for the preparation of electrostatographic toner comprising the steps of:

(a) forming a melt dispersion by mixing a pigment, a low melting point hydrophobic wax and a first polymer material at a temperature above the melting point of the wax whereby the wax melts and forms an irregular coating on the surface of the pigment;

(b) mixing the melt dispersion with a solvent and optionally a second polymer material, and optionally a charge control agent to form an organic phase, (c) dispersing the organic phase in an aqueous phase comprising a promoter and a particulate stabilizer and homogenizing the mixture, and (d) evaporating the solvent and washing and drying the resultant product.

2. The method of claim 1 wherein the melt dispersion comprises up to 50%, by weight, pigment and up to 25%, by weight, low melting point reactive wax.

3. The method of claim 1 wherein the relationship between the aqueous phase and the organic phase, by volume, ranges from 1.5:1 to 9:1.

4. The method of claim 1 wherein the low melting point wax has a melting point within the range of 55°-120° C.

5. The method of claim 1 wherein the particulate stabilizer is selected from the group consisting of highly cross linked latex particles and $SiO_2$.

6. The method of claim 1 wherein the first and second polymer materials are the same.

7. The method of claim 1 wherein the pigment is a phthalocyanine pigment.

8. The method of with claim 1 wherein said melt dispersion comprises a copolymer of vinyl toluene and ethyl hexyl acrylate, a quinacridone magenta pigment and a reactive wax having a melting point of 83° C.

9. The method of claim 8 wherein the second polymer comprises a butyl acrylate and styrene coploymer.

10. The method of claim 8 wherein the particulate stabilizer comprises latex particles.

11. Electrostatographic toner prepared in accordance with claim 1 including a matrix of toner resin comprising a wax coated pigment, the toner having a narrow distribution of charge from toner particle to toner particle.

12. In a method for preparing electrostatographic toner by dispersing an organic phase in an aqueous phase to yield a layer of particulate suspension stabilizer on the surface of a polymer, the improvement which comprises forming a melt dispersion comprising a pigment, a first polymer material and a low melting point wax and mixing the melt dispersion with a second polymer material, a charge agent and a solvent to form an organic phase.

13. Electrostatographic toner prepared in accordance with claim 12 including a matrix of toner resin comprising a wax coated pigment, the toner having a narrow distribution of charge from toner particle to toner particle.

14. The method of claim 12 wherein the low melting point wax has a melting point within the range of 55°-120° C.

15. The method of claim 12 wherein the pigment is Novaperm Yellow.

16. The method of claim 12 wherein the low melting point wax has a melting temperature of 83° C.

17. The method of claim 12 wherein the solvent is dichloromethane.

18. The method of claim 12 wherein the solvent is ethyl acetate.

* * * * *